US006167939B1

(12) United States Patent
Barone

(10) Patent No.: US 6,167,939 B1
(45) Date of Patent: Jan. 2, 2001

(54) NO-SEW DRAPERY SYSTEM

(76) Inventor: Dana A. Barone, 718 Union Ave., Brielle, NJ (US) 08730

( * ) Notice: Under 35 U.S.C. 154(b), the term of this patent shall be extended for 0 days.

(21) Appl. No.: 09/369,808

(22) Filed: Aug. 6, 1999

Related U.S. Application Data

(60) Provisional application No. 60/095,866, filed on Aug. 10, 1998.

(51) Int. Cl.[7] ..... A47H 1/00

(52) U.S. Cl. ..... 160/330; 160/383; 160/395; 248/261; 16/940

(58) Field of Search ..... 160/19, 38, 39, 160/330, 382, 395, 396, 397, 400, 401, 403, 902; 16/94 D, 94 R, 95 D; 248/261, 262, 265, 267

(56) References Cited

U.S. PATENT DOCUMENTS

| | | | | |
|---|---|---|---|---|
| 1,559,531 | * | 10/1925 | Yehle | 160/401 |
| 3,217,690 | * | 11/1965 | Mihalisin | 160/395 |
| 3,379,237 | * | 4/1968 | Worthington | 160/383 |
| 3,724,524 | * | 4/1973 | Potter | 160/397 X |
| 4,258,778 | * | 3/1981 | Upton | 160/383 |
| 4,935,988 | * | 6/1990 | Ford et al. | 160/38 X |
| 5,060,710 | * | 10/1991 | Hearer | 160/902 X |
| 5,152,331 | * | 10/1992 | Barone | 160/38 |
| 5,259,520 | * | 11/1993 | Roggio et al. | 16/94 D |
| 5,361,521 | * | 11/1994 | Barone | 160/39 |
| 5,505,245 | * | 4/1996 | Badalamenti | 160/38 |
| 5,944,085 | * | 8/1999 | Malott | 160/395 X |
| 5,979,848 | * | 11/1999 | Kuthy | 160/902 X |

FOREIGN PATENT DOCUMENTS

| | | | | |
|---|---|---|---|---|
| 531274 | * | 3/1993 | (EP) | 160/330 |
| 68 7163 | * | 4/1930 | (FR) | 160/383 |

* cited by examiner

*Primary Examiner*—Bruce A. Lev
(74) *Attorney, Agent, or Firm*—Connolly Bove Lodge & Hutz LLP

(57) ABSTRACT

The no-sew window drapery system comprises tucking fabric into a rod. The rod has a profile that creates an opening across the entire length and sufficient space in the interior to accept the fabric. The rod may additionally incorporate a locking system to secure the fabric ends inside the rod. The fabric employed is fed into the opening created by the profile, arranged into the style desired and secured into place. Because of the characteristics of the plastic, and the close-fit force exerted on the fabric, the result is to provide a rod which holds the fabric in place. Yet it is easy to install the fabric without the need for any sewing and still give the fabric a customized look.

17 Claims, 3 Drawing Sheets

NO-SEW DRAPERY SYSTEM

CROSS REFERENCE TO RELATED APPLICATION

This application is based upon provisional application Serial No. 60/095,866, filed Aug. 10, 1998.

FIELD OF THE INVENTION

This invention relates to styles for decorating or covering windows and, more particularly, to window treatment styles for creating valance and "topper" arrangements simply and inexpensively.

BACKGROUND OF THE INVENTION

As it is well known and understood, window treatment stylings are typically manufactured by skilled professionals who either have "ready-made" styles mass produced in which case the cost is low and the selection is limited, or have "custom" styles attained through a designer on an individual basis, in which case the selection is unlimited but the costs are extremely high. Also these window treatments are fairly permanent due to the sewing process involved. It would be advantageous, therefore, if a new and unique manufacture were available to make these applications more cost effective, and to provide a "custom look" easily and inexpensively with the additional advantage of being able to change the fabric or styling with little effort. In my U.S. Pat. Nos. 5,152,331 and 5,383,635, I have disclosed various techniques for providing window treatment, fabric wrapped tables and the like wherein the fabric is secured around a semi-soft foam in a no-sew wrap and tuck process. It would be advantageous through this invention to create drapery pole styles where gathered as well as flat fabric styles can be easily created.

SUMMARY OF THE INVENTION

As will become clear in the description that follows, the drapery system of the present invention accepts the same types of coverings as now available in the industry, and allows for a multiplicity of designs, by inserting fabrics in different stylings and by combining different shapes of decorative hardware. As will also be seen, the window treatment will be easy to create without any sewing and just as easy to install, using a simple screw-in device. As will also become clear from the description below, the window treatment of the invention is reusable, allowing an easy change of fabrics and or stylings, all in an easy, fast and inexpensive manner.

More particularly, and as will be seen from the description below, the window treatment of the invention follows from the use of a plastic rod or length whose profile allows for the insertion of fabric. The rod utilized will be seen to be designed as a particular profile which creates an opening across the length of the rod. The fabric employed will be seen to have its ends fitted through the opening of the profile so that they are stored inside the rod. Because of the characteristics of the rigid plastic, having the ability to stretch open enough to insert the fabric, yet exerting enough pressure against the fabric after it is installed to be secured into place, the end result is to provide a rod which holds the fabric in place. Additionally, the profile may provide for a method of locking or closure of the ends to further secure the fabric in place. And because of these characteristics, the window treatment can thus be completed without the need for any "sewing" whatsoever, so as to provide a customized look easily and inexpensively.

As will also be seen, by using such a drapery system of the invention, it then becomes possible, and as will be more fully described below, to design and arrange the treatment in different stylings as well as to combine different lengths and decorative hardware to create modern, traditional, or other arrangements or stylings according to one's preference.

DETAILED DESCRIPTION

Figure 1:
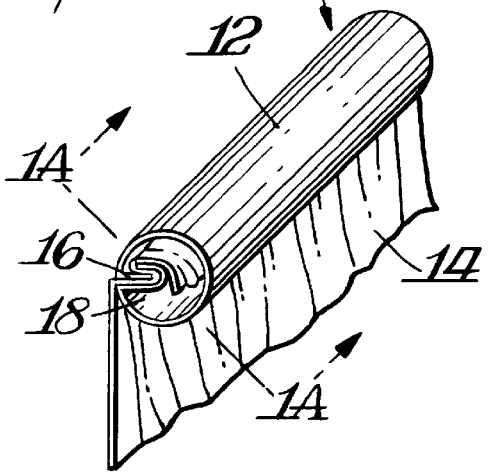
FIG. 1 is a perspective view of rigid plastic rod profile of pre-determined shape and dimension, in accordance with this invention.
Figure 1A:
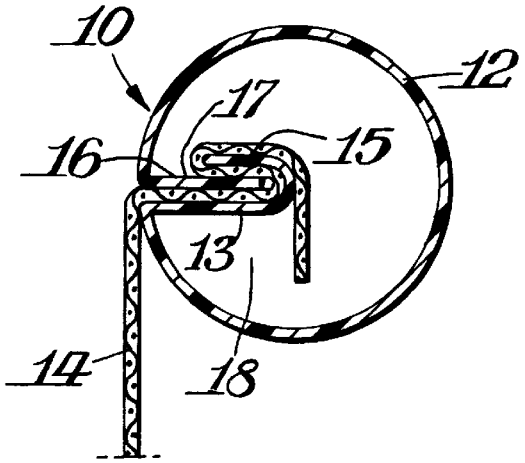
FIG. 1A is a cross-sectional view taken through FIG. 1 along the line 1A—1A.
Figure 2:
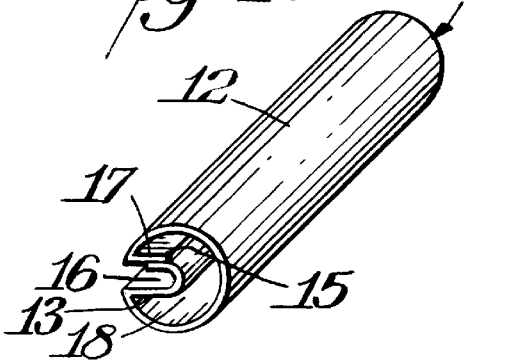
FIGS. 2 and 3 illustrate the opened and closed positions of the rod profile where one would insert fabric to be held in place.
Figure 3:
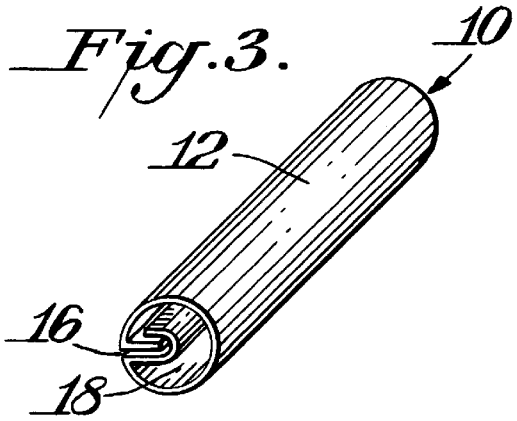

Referring now more particularly to FIGS. 1–3, system 10 includes a plastic profile 12 of pre-determined shape and dimension, cut to any length desired, either by the purchaser of the rod, or by the manufacturer of prearranged treatments. The rod profile shown in use (FIG. 1) is of hollow tubular form into which fabric 14 is tucked through the opening 16 so that the fabric may be stored in the interior cavity 18 of the profile. The fabric may be doubled over, with the raw ends inserting into slit 16 as to give a finished look. See FIGS. 1 and 1A.

Fabric 14 or the like may be styled flat and smooth or gathered and ruffled into place while the profile is in the open position (FIG. 2) and then fixed into place when put into the closed position (FIG. 3). While the insertion and arrangement of fabric can be done by hand, the use of a straight edge, such as a ruler may also be utilized. But by employing a rigid plastic of polyvinylchloride, for example, the fabric 14 will be held in place, especially when profile 12 with opening 16 and cavity 18 is of a particular shape to exert pressure on fabric 14 and close in a locked position to keep the fabric in place. Such polyvinylchloride plastic may have a wall thickness between 0.020 and 0.070. Other rigid materials and thicknesses may be used for rod or profile 12. Preferably the material should be sufficiently rigid to be shape retaining but capable of being distorted out of its shape and then have enough resiliency to return toward its undistorted shape.

FIG. 1A shows the interlocking relationship between the fabric 14 and the tubular profile or rod 12. As shown therein, and as also shown in various other figures, the slit 16 is defined by a pair of generally parallel spaced edges. One of the edges has a guide surface 13 and then bends up and around to terminate in an offset portion 15 which is generally parallel to the guide surface 13. This forms the U-shaped edge best shown in FIG. 2 and into which the fabric 14 would be inserted. The other edge which forms slit 16 is the locking edge 17 which likewise is generally parallel to a guide surface 13 and offset portion 15. When the fabric has been insected into the slit 16 by being pushed into the U-shaped edge formed by guide surface 13 and offset portion 15, the hollow rod is squeezed so that the locking portion 17 may be moved outwardly beyond surface 13 and squeezed sufficiently downwardly to be located directly in line with the U-shaped edge. Upon release of pressure the locking edge then enters the U-shaped edge and presses into the fabric 14 as illustrated in FIG. 1A. Accordingly, the fabric 14 is forced to assume a tortuous path wherein the fabric is locked between guide surface 13 and locking portion 17 and then is located around locking portion 17 between locking portion 17 and offset portion 15. Finally, fabric 14 extends over and around offset portion 15 and into cavity 18.

Figure 1B:
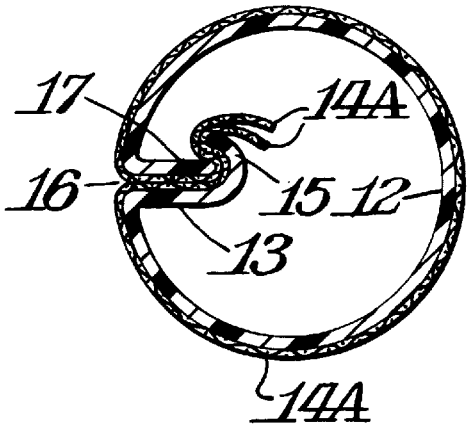
FIGS. 1B and 1C are views similar to FIG. 1A of alternative practices of the invention.
Figure 1C:
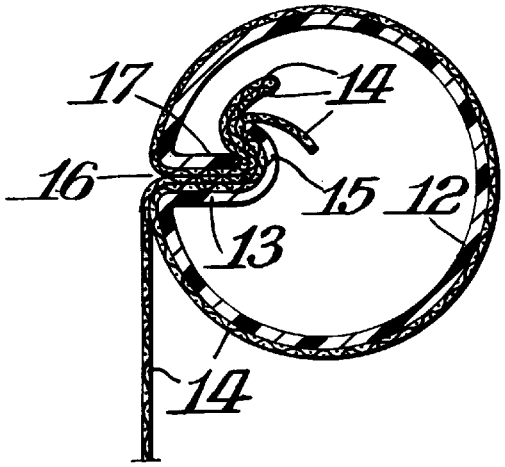

The invention may also be practiced by covering the rod 12 with a fabric. FIG. 1B, for example, shows how a fabric 14A may be wrapped around rod 12 prior to the application of fabric 14. As shown therein fabric 14A, after being wrapped around rod 12 is held in place in slit 16 by wrapping around the slit edges 13, 15 and 17. FIG. 1C shows an alternative where fabric 14 is wrapped rod 12 and locked in slit 16 while hanging downwardly to form the drape.

When it is desired to remove the fabric, the reverse procedures are used wherein the rod 12 is squeezed to move locking portion 17 outwardly from being within the U-shaped edge. The rod is released when locking portion 17 is again above offset portion 15 as shown in FIG. 2. This permits the fabric to be removed and a new fabric to be inserted.

As will be appreciated, such rod 12 of the invention requires no saving to hold fabric 14 in place, can be cut to measure and can be easily disassembled to change fabric stylings as desired at later times.

As is apparent from the above description and from FIGS. 1, 1A, 2 and 3 the slit 16 includes a U shaped edge which forms an open channel between guide surface 13 and offset portion 15. The open channel is exposed to the exterior to permit a fabric 14 to be placed in the open channel and extend around offset portion 15. Offset portion 15 is thus spaced from the inner surface of the rod 12 a sufficient distance to accommodate the fabric 14. As best shown in FIG. 1A, offset portion 15 is substantially shorter in length than the length of guide surface 13 to permit the creation of the open channel, and yet provide the sufficient clearance which is needed. The above figures also clearly illustrate that the U shaped edge is oriented transverse to a tangent to the generally closed periphery of rod 12 over the remainder of the rod. FIG. 1A for example, shows the fabric 14 to be in a tangential relationship with the periphery, while the U shaped edge formed by guide surface 13 and offset portion 15 and the straight locking edge 17 are generally transverse to that tangential direction. As also illustrated in FIG. 1A, slit 16 extends radially from the center of the rod 12. As further shown, locking edge 17 is of sufficient length relative to offset portion 15 so that the locking edge extends beyond the spacing between the inner surface of rod 12 and offset portion 15, and the locking edge 17 extends sufficiently into the open channel. These relative lengths permit the locking edge 17 to be easily withdrawn from the channel upon a squeezing of the rod 12, as previously described.

The invention may broadly be practiced where the slit 16 omits the offset portion 15. In such practice, the slit could be distorted by moving locking portion 17 away from guide surface 13 to enlarge the size of slit 16. After the fabric has been inserted over guide surface 13, locking portion 17 is released and presses against the fabric to hold the fabric in slit 16.

While rod 12 is shown as circular in cross section, other shapes such as oval, square, rectangular, etc. may also be used.

Figure 4:
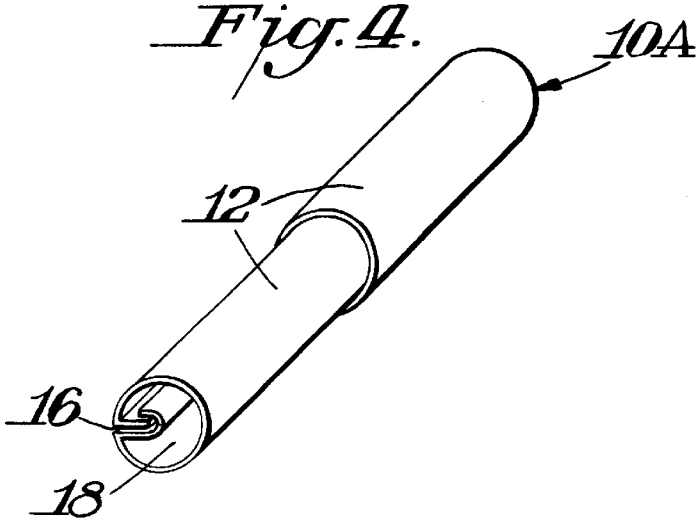
FIG. 4 shows a manner of joining two typical lengths together in what could be a telescoping method to develop window treatment designs of varied sizes.

As will be apparent, some window treatment designs, according to the size needed, might require the rod lengths to be joined as shown in FIG. 4 and because of the flexibility or resiliency of the rigid plastic rod 12, this can be accomplished by inserting one rod inside the other so the profile shapes interlock with one another and create system 10A.

Figure 5A:
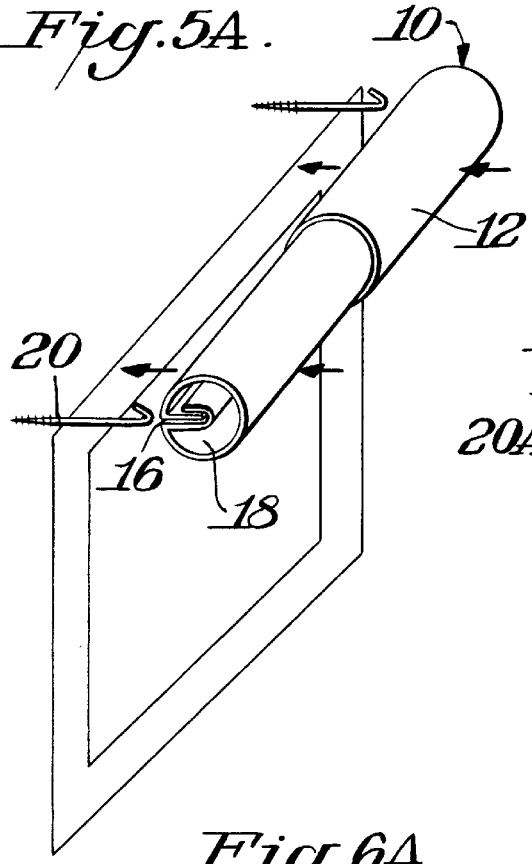
FIGS. 5A and 5B are perspective views of alternative methods of securing the window treatment of this invention.
Figure 5B:
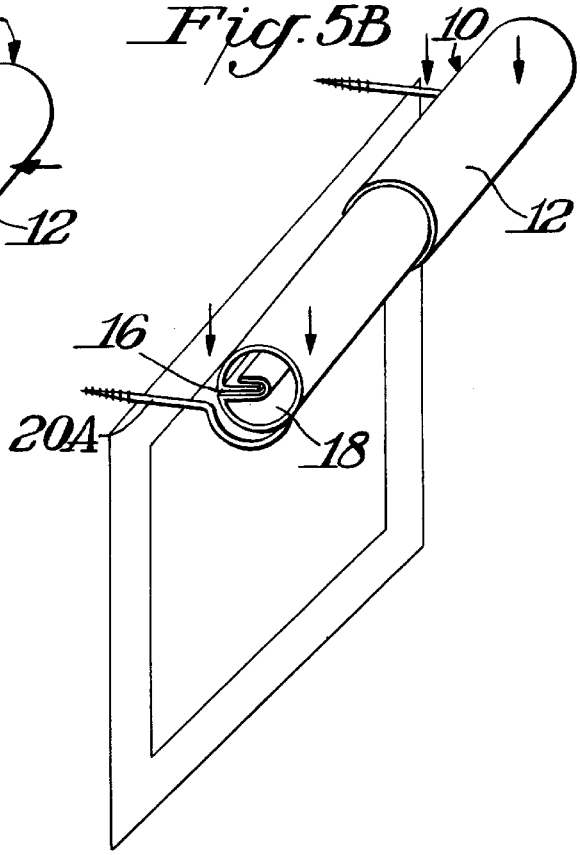

In FIGS. 5A and 5B, show two methods for installing the window treatment of the invention. There, fastening members, such as screws 20 or 20A are installed into the wall or other support structure either above or on the window molding, with the bent end, as shown, either hooking into the opening 16 at any place across the rod as shown in FIG. 5A, or by cradling the rod 12 to support it from the bottom as shown in FIG. 5B.

Figure 6D:
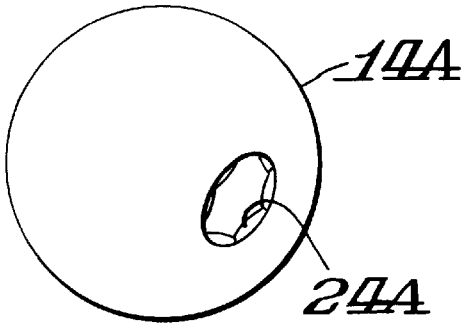
FIGS. 6A–6D show various end treatments including end caps, finials and elbow returns used with this invention.
Figure 6A:
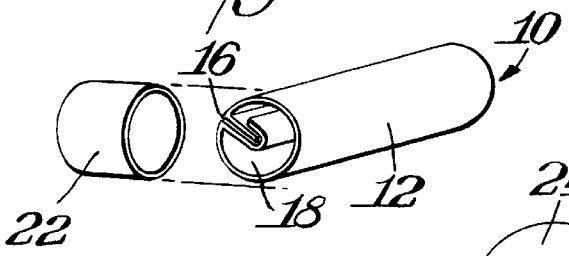
Figure 6B:
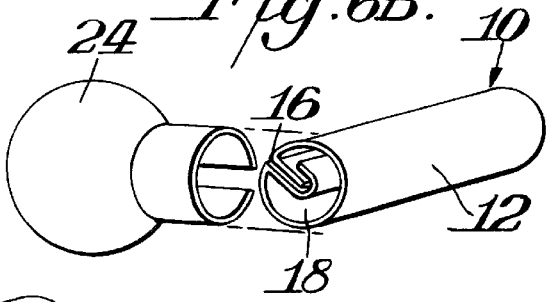
Figure 6C:
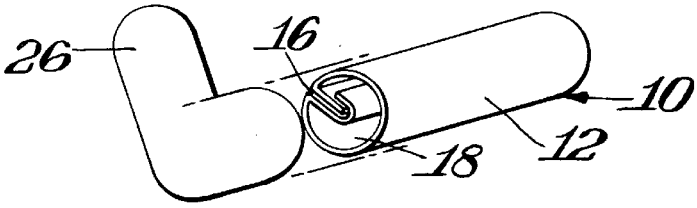

FIGS. 6A–6C illustrate different treatments to finish off one or preferably both ends of a rod. The end piece is preferably made of the same or like material which has been cast, molded or extruded into a particular shape. Such shapes may be employed at the rods ends by fitting the treatments either over the edges of the rod profile 12 as end cap 22 shown in FIG. 6A or by inserting a projection into the cavity 18, as finials 24 shown in FIG. 6B or by inserting the elbow 26, which is made from the same profile shape, into or over the rod 12, the same way one would connect rod lengths, as shown in FIG. 6C.

FIG. 6D shows an alternative where the finial 24A has a cavity instead of a projection. A fabric 14A is wrapped around finial 24A and then tucked into the finial cavity. The fabric wrapped finial is then telescoped over rod 12 and thereby mounted to rod 12. End pieces 22 and 26 may also be modified to be wrapped by a fabric, such as by having a cavity into which the fabric would be tucked with the end piece telescoped over the rod. The wrapping of the fabric and the securing of the end piece to the rod may be accomplished in other manners in accordance with the invention.

While there have been described what are considered to be the preferred embodiments of the present invention, it will be readily appreciated that modifications can be made by those skilled in the art without departing from the scope of the teachings herein. Thus, while a profile 12 with opening 16 and cavity 18 has been described for accepting the fabric 14, any shaped profile with sufficient opening and interior space can be employed as long as there is exertion on the fabric 14 enough to hold it in place. In similar fashion, while the opening 16 preferably extends the entire length of the rod 12, it will be seen that in an actual construction, all that is necessary is that the ends of rod 12 have a sufficient opening enough to accept the insertion of fabric 14.

In the preferred practice of this invention the profile rod 12 is of completely hollow tubular form. This permits a rigid material to be used while still having sufficient springiness or resiliency to permit a squeezing and locking action to take place for inserting and holding the fabric in place. The invention in its broad sense, however, may also be practiced where some or all of the interior is solid and a tortuous path is created between a guide surface, a locking portion and an offset portion having the physical relationship shown in FIG. 1A and in FIG. 3. In such practice it would be necessary to force the fabric into the slit and around the guide surface and then around the offset portion. The illustrated embodiment, however, is the preferred practice since it permits the fabric to be readily inserted into the open U-shaped edge and then locked in place by the springiness of the looking edge. Additionally, the completely open or hollow tubular form for the rod 12 provides the cavity for readily receiving the end portion of the fabric.

In the preferred practice of the invention the edges which form slit 16 are of continuous unbroken construction. The invention, however, may be practiced where the edges themselves are slit to form a plurality of spring fingers wherein one spring finger would be of U-shaped form to provide the guide surface 13 and offset portion 15 and the other spring fingers would be of generally planar form to provide the locking portion 17.

Other variations of the invention will be apparent to one reading the specification herein.

What is claimed is:

1. A no-sew drapery rod system for releasably mounting a fabric comprising an elongated rigid rod, said rod having an outer surface which forms a generally closed periphery, a longitudinal slit formed in said outer surface of said rod and extending into the interior of said rod, said slit being defined by a pair of generally parallel spaced edges, one of said edges being generally U shaped with a guide surface extending inwardly from said outer surface into said interior of said rod and merging into an offset portion disposed within said interior of said rod to form an open channel between said guide surface and said offset portion, said U shape edge being oriented in a direction generally transverse to the tangent to said generally closed periphery of said rod with said channel being exposed to the exterior of said rod to facilitate the fabric being inserted into said channel and into said interior of said rod, the other of said edges being an inwardly directed locking edge oriented in a direction generally transverse to the tangent to said generally closed periphery of said rod, said rod being made of a material having sufficient resiliency whereby said locking edge may be totally outside of said channel disposed closer to said offset portion than to said guide surface before the fabric is inserted into said channel, said locking edge being located totally within said channel after the fabric is inserted into said channel to extend into contact with the fabric and lock the fabric to said rod, said offset portion being substantially shorter in length than said guide surface, said offset portion being spaced away from the inner surface of said generally closed periphery to permit the fabric to be disposed in said channel and be disposed at least partially around said offset portion during the insertion of said locking edge into said channel to firmly mount the fabric to said rod, and said locking edge having a sufficient length relative to the length of said offset portion to extend beyond the spacing between said offset portion and said inner surface of said rod and to extend into said channel when said system is in a locking condition and to facilitate said locking edge being withdrawn from said channel upon the squeezing of said rod to readily move said locking edge away from said offset portion and thereby permit said locking edge to be disposed above said offset portion and expose the fabric to permit the fabric to be removed from said channel.

2. The system of claim 1 wherein said slit extends substantially the entire length of said rod.

3. The system of claim 2 wherein said rod is of tubular form and hollow.

4. The system of claim 3 wherein said rod is a first rod, including a second elongated rigid rod telescoped into said elongated rigid first rod to provide a combined length of said first rod and said second rod which is greater than the length of said first rod alone.

5. The system of claim 3 including fastening members for mounting said rod to a support structure.

6. The system of claim 5 wherein said fastening member include a fastener having a hook end engaged with said rod.

7. The system of claim 5 wherein said fastening members includes a fastener having a cradle into which said rod is positioned.

8. The system of claim 3 including an end piece mounted over at least one longitudinal end of said rod.

9. The system of claim 1 wherein said locking edge is parallel to said guide surface.

10. The system of claim 1 wherein said generally closed periphery shaped of said rod is generally continuous closed arc.

11. The system of claim 10 wherein said channel is generally radially oriented with respect to the center of said closed arc.

12. The system of claim 10 wherein closed arc is free of surface protuberances when said locking edge is in said channel.

13. The system of claim 1 wherein said offset portion is shorter in length than the length of said locking edge.

14. A method of forming a no-sew drapery system comprising providing an elongated rigid rod having a longitudinal slit formed in the outer surface of the rod and extending into the interior of the rod, the slit being formed by a pair of spaced edges, one of the edges being generally U shaped with a guide surface extending inwardly from the outer surface into the interior of the rod and merging into an offset portion disposed totally within the interior of the rod and spaced from the inner surface of the rod to form an open channel located transverse to the tangent to the general periphery of the rod and the other edge being a locking edge located transverse to the tangent to the general periphery of the rod, the length of the locking edge being longer than the spacing between the offset portion and the inner surface of the rod so that the locking edge may extend into the channel, inserting a fabric into the channel and at least partially around the offset portion between the spacing between the end of the offset portion and the inner surface of the rod, squeezing the rod to dispose the locking edge in line with the channel, inserting the locking edge into the channel to wrap the fabric around the locking edge while being wrapped at least partially around the offset portion, and releasing the rod to maintain the fabric locked to the rod.

15. The method of claim 14 including mounting an end piece at the longitudinal end of the rod.

16. The method of claim 14 including squeezing the rod to remove the locking edge from the channel and thereby expose the fabric, and removing the fabric from the channel to permit a different fabric to be mounted to the rod.

17. The method of claim 14 including disposing the fabric in the channel in a gathered and ruffled condition.

* * * * *